US007229344B1

(12) United States Patent
Wu

(10) Patent No.: US 7,229,344 B1
(45) Date of Patent: Jun. 12, 2007

(54) BLADE SHARPENING TOOL

(75) Inventor: Shih-Piao Wu, Changhua Hsien (TW)

(73) Assignee: Jiin Haur Industrial Co., Ltd., Changhua Hsien (TW)

( * ) Notice: Subject to any disclaimer, the term of this patent is extended or adjusted under 35 U.S.C. 154(b) by 0 days.

(21) Appl. No.: 11/504,810

(22) Filed: Aug. 15, 2006

(51) Int. Cl.
*B24B 23/00* (2006.01)
*B24D 15/00* (2006.01)

(52) U.S. Cl. ..... 451/349; 451/525

(58) Field of Classification Search ..... 451/349, 451/523–525

See application file for complete search history.

(56) References Cited

U.S. PATENT DOCUMENTS

| | | | | | |
|---|---|---|---|---|---|
| 2,504,423 | A * | 4/1950 | Johnson et al. | ..... | 451/175 |
| 3,528,204 | A * | 9/1970 | McCue | ..... | 451/349 |
| 5,371,977 | A * | 12/1994 | Liner | ..... | 451/349 |
| 5,582,535 | A * | 12/1996 | Friel | ..... | 451/45 |
| 5,868,611 | A * | 2/1999 | Friel | ..... | 451/461 |
| 6,129,616 | A * | 10/2000 | Klotz | ..... | 451/349 |
| 6,393,946 | B1 * | 5/2002 | Kenesky et al. | ..... | 76/86 |
| 6,398,633 | B1 * | 6/2002 | Lothe | ..... | 451/545 |
| 6,817,269 | B1 * | 11/2004 | Grace, Jr. | ..... | 76/86 |
| 6,846,229 | B1 * | 1/2005 | Ranieri | ..... | 451/312 |
| 7,001,259 | B1 * | 2/2006 | Wu | ..... | 451/349 |
| 7,066,796 | B2 * | 6/2006 | Pfaus | ..... | 451/344 |
| 2005/0202766 | A1 * | 9/2005 | Pfaus | ..... | 451/344 |

* cited by examiner

*Primary Examiner*—M. Rachuba
(74) *Attorney, Agent, or Firm*—Alan Kamrath; Kamrath & Associates PA

(57) ABSTRACT

A blade sharpening tool includes a main body, a first grinding unit, a second grinding unit, and a protective jacket. The first grinding unit is directed toward a direction in line with the axial direction of the main body. Thus, when the first grinding unit is pressed to move on the blade of the gardening shears, the first grinding unit is movable in the direction the same as that of the blade, so that the first grinding unit is operated easily and quickly to facilitate the user operating the blade sharpening tool in an energy-saving manner. In addition, the mating surface of the main body has a shape corresponding to that of the jaw of the gardening shears to facilitate movement of the first grinding unit on the blade.

17 Claims, 9 Drawing Sheets

BLADE SHARPENING TOOL

BACKGROUND OF THE INVENTION

1. Field of the Invention

The present invention relates to a blade sharpening tool and, more particularly, to a blade sharpening tool for grinding a blade of a cutting tool, such as a knife, a pair of gardening shears or the like.

2. Description of the Related Art

A conventional blade sharpening tool 10 in accordance with the prior art shown in FIGS. 8 and 9 comprises a handle 11 having a front end formed with a mounting head 12, and a grindstone 13 secured on a side of the mounting head 12 of the handle 11. As shown in FIG. 9, when the blade sharpening tool 10 is available for a pair of gardening shears 14, the grindstone 13 is rested on the blade 15 of the gardening shears 14. Then, the grindstone 13 is pressed to move on the blade 15 of the gardening shears 14 in multiple directions as indicated by the arrow shown in FIG. 9 so as to grind and sharpen the blade 15 of the gardening shears 14.

However, the user has to exert a larger force to press the grindstone 13 onto the blade 15 of the gardening shears 14 to grind and sharpen the blade 15 of the gardening shears 14 exactly, thereby wasting the user's energy, and thereby causing inconvenience to the user. In addition, when the user's one hand holds the handle 11 to move the grindstone 13, the grindstone 13 easily slips from the blade 15 of the gardening shears 14 due to an excessive force or a vibration, so that the blade 15 of the gardening shears 14 is easily deflected to hurt the user's one hand, thereby causing danger to the user.

BRIEF SUMMARY OF THE INVENTION

In accordance with the present invention, there is provided a blade sharpening tool, comprising a main body having a front portion integrally formed with an extension neck and a rear portion formed with a grip portion, the extension neck of the main body having a front end formed with a first positioning recess and a mediate portion having a bottom formed with a second positioning recess, a first grinding unit mounted in the first positioning recess of the main body, a second grinding unit mounted in the second positioning recess of the main body, and a protective jacket mounted on the main body and located between the extension neck and the grip portion of the main body.

The primary objective of the present invention is to provide a blade sharpening tool, wherein when the first grinding unit is pressed to move on the blade of the gardening shears, the first grinding unit is movable in the direction the same as that of the blade of the gardening shears, so that the first grinding unit is operated easily and quickly to facilitate the user operating the blade sharpening tool in an energy-saving manner.

Another objective of the present invention is to provide a blade sharpening tool, wherein the mating surface of the extension neck of the main body has a shape corresponding to that of the jaw of the gardening shears to facilitate movement of the first grinding unit on the blade of the gardening shears.

A further objective of the present invention is to provide a blade sharpening tool, wherein the protective jacket is located between the extension neck and the grip portion of the main body to separate the blade of the gardening shears from the grip portion of the main body to protect the user's one hand.

A further objective of the present invention is to provide a blade sharpening tool, wherein the second grinding unit is directed toward a direction perpendicular to that of the first grinding unit, so that the blade sharpening tool is operated in two perpendicular manner, thereby enhancing the versatility of the blade sharpening tool.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
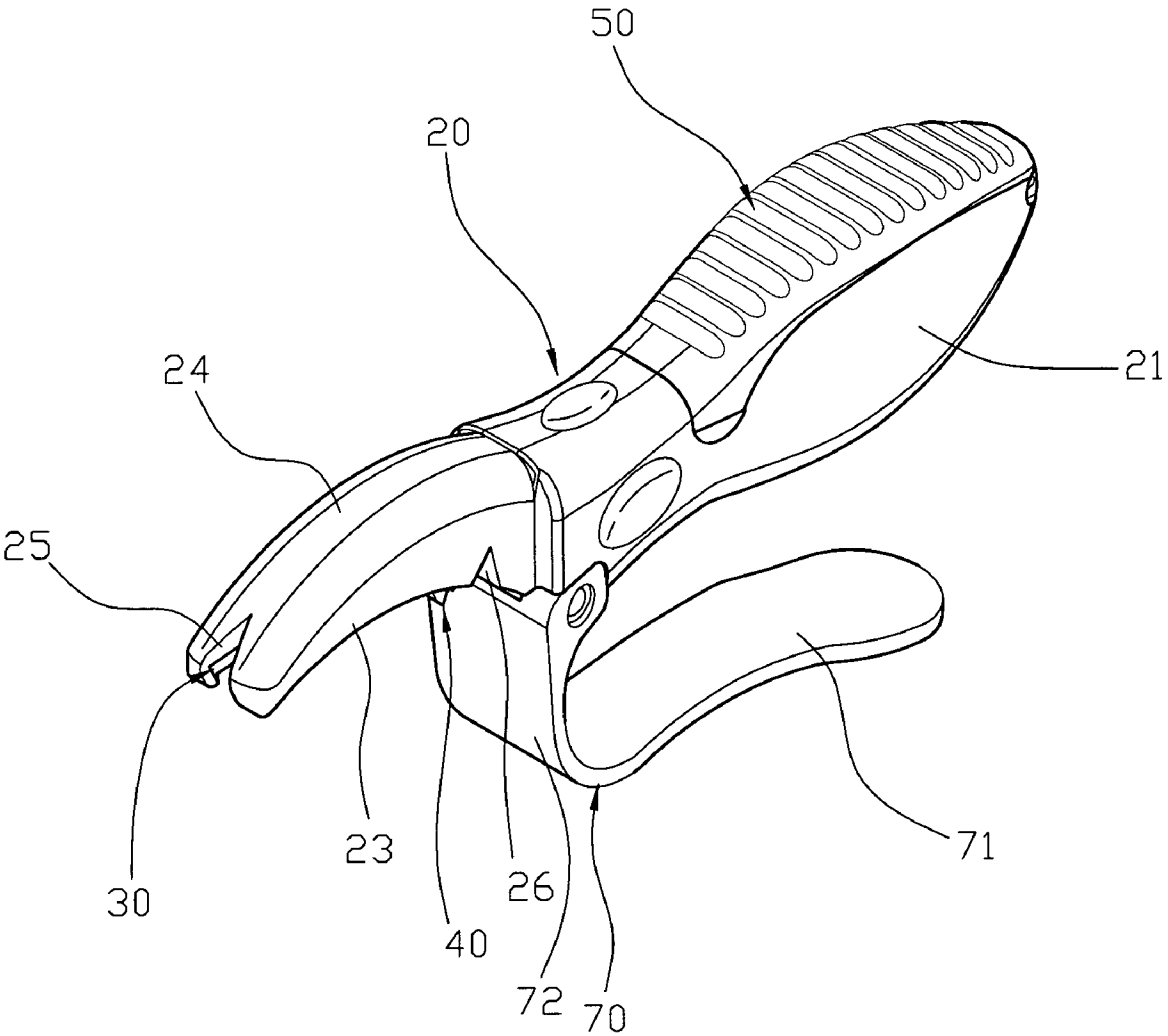
FIG. 1 is a perspective view of a blade sharpening tool in accordance with the preferred embodiment of the present invention.
Figure 2:
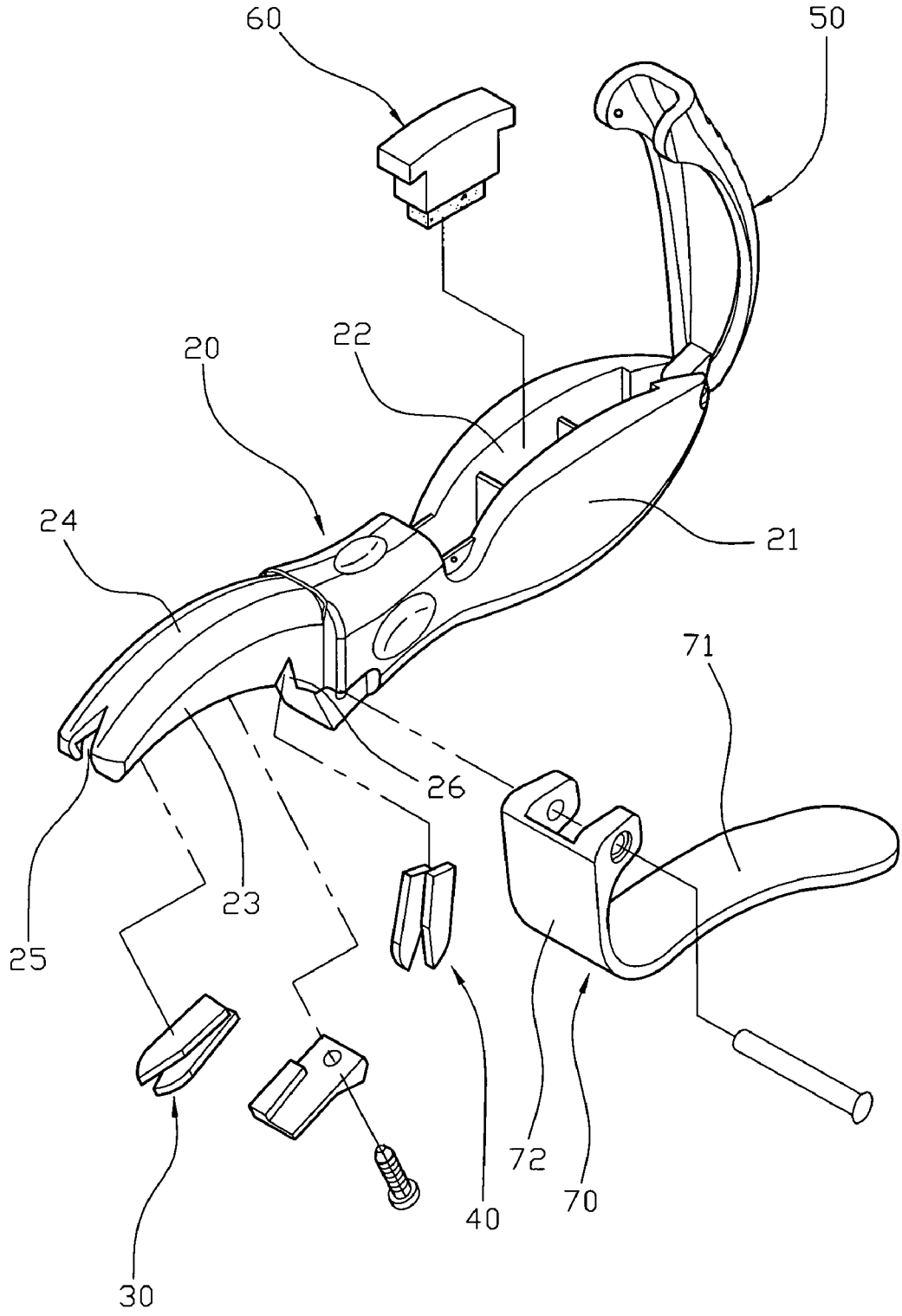
FIG. 2 is an exploded perspective view of the blade sharpening tool as shown in FIG. 1.
Figure 3:
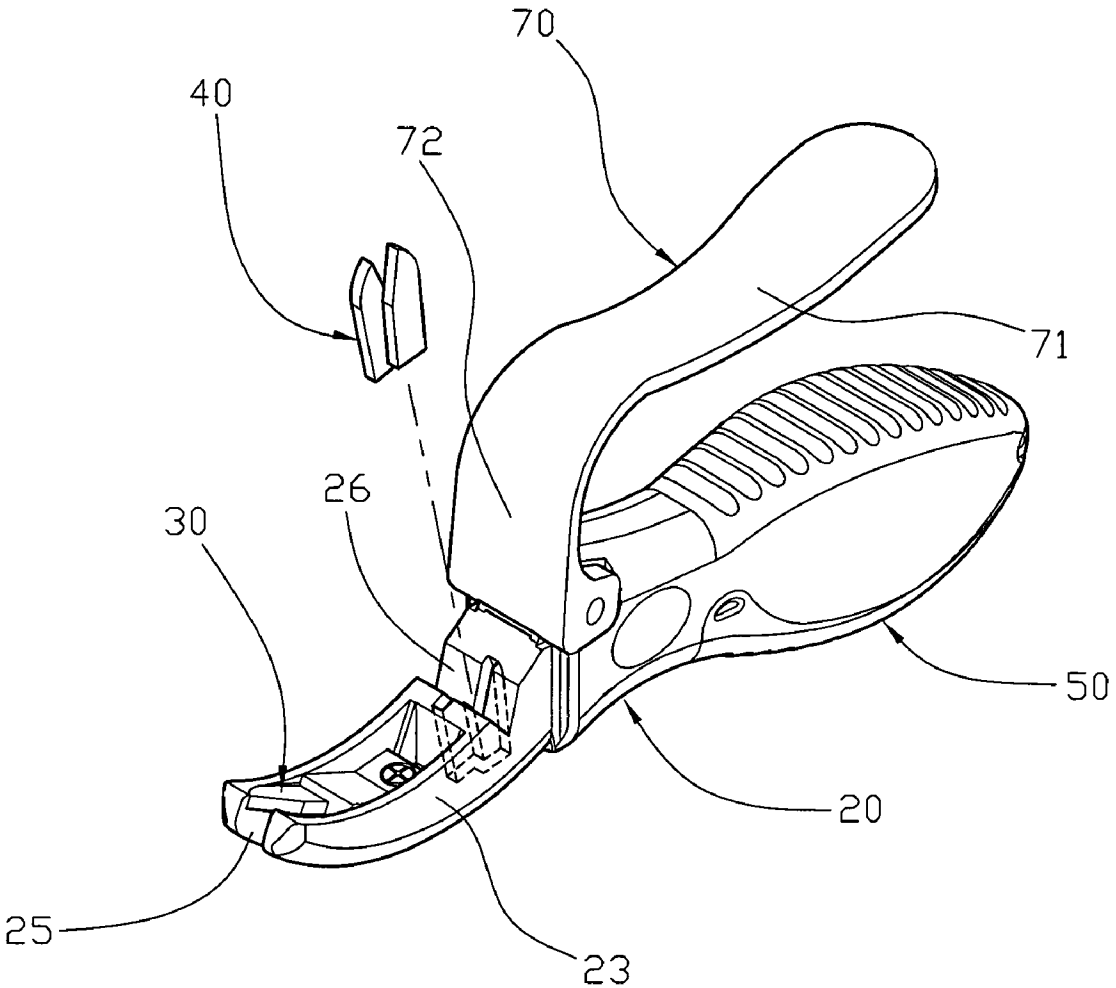
FIG. 3 is a partially exploded perspective view of the blade sharpening tool as shown in FIG. 1.
Figure 4:
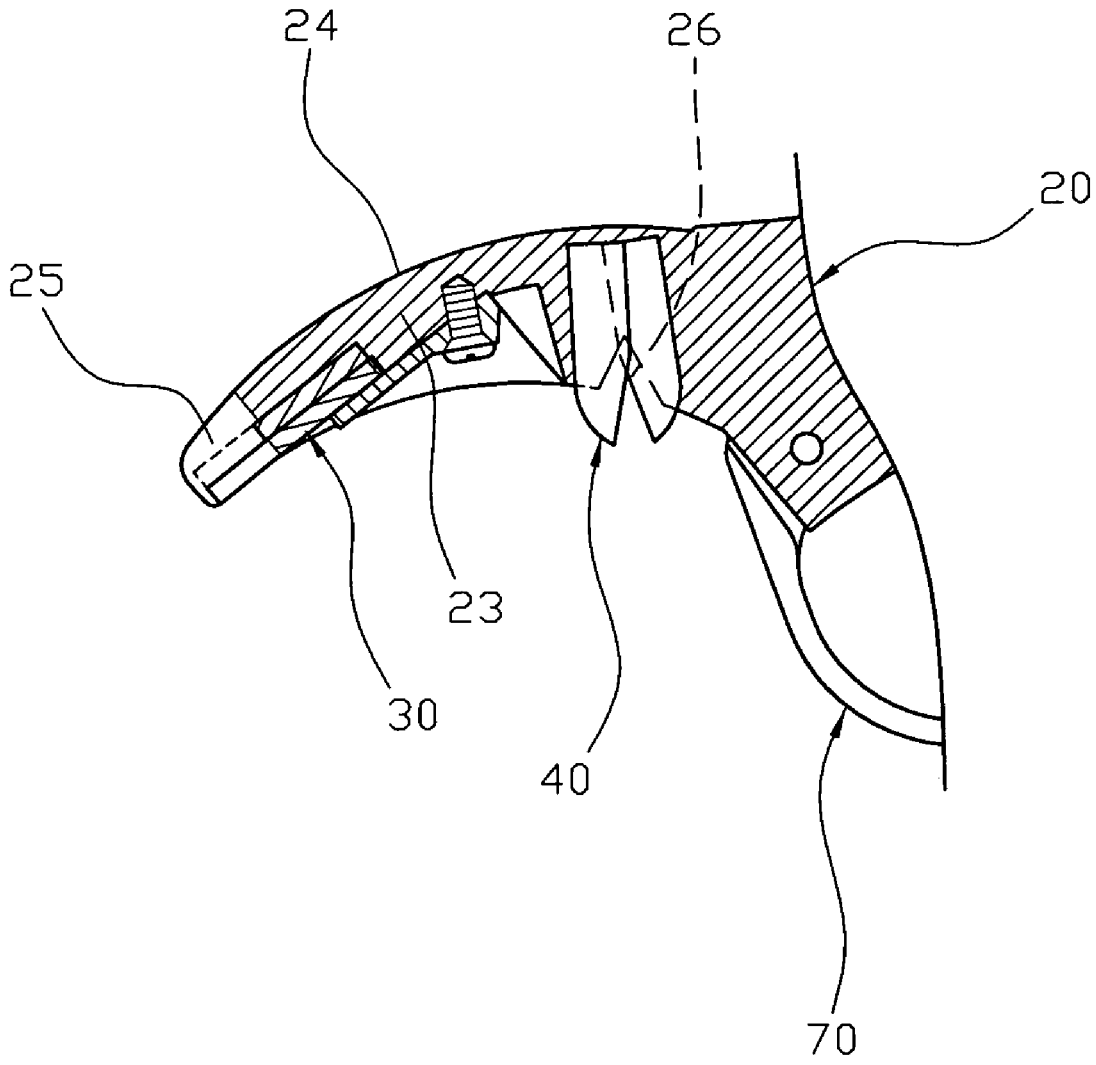
FIG. 4 is a partially plan cross-sectional view of the blade sharpening tool as shown in FIG. 1.

Referring to the drawings and initially to FIGS. 1–4, a blade sharpening tool in accordance with the preferred embodiment of the present invention comprises a main body 20, a first grinding unit 30, a second grinding unit 40, a protective jacket 70, a cover 50, and an oil impregnated rubber 60.

The main body 20 has a front portion integrally formed with an extension neck 23 and a rear portion formed with a grip portion 21. The grip portion 21 of the main body 20 has an inside formed with a receiving chamber 22. The extension neck 23 of the main body 20 has an upper portion formed with a substantially arc-shaped mating surface 24 and has a front end formed with a first positioning recess 25 that is opened in a direction in line with an axial direction of the main body 20 and a rear end connected to the grip portion 21. The first positioning recess 25 of the main body 20 is extended through an end face of the front end of the extension neck 23 and has a substantially V-shaped cross-sectional profile. The extension neck 23 of the main body 20 has a mediate portion having a bottom formed with a second positioning recess 26 that is opened in a direction perpendicular to that of the first positioning recess 25.

The first grinding unit 30 is mounted in the first positioning recess 25 of the main body 20. The first grinding unit 30, the extension neck 23 of the main body 20 and the grip portion 21 of the main body 20 are arranged in a same line. Thus, the first grinding unit 30 is directed toward a direction in line with the axial direction of the main body 20.

The second grinding unit 40 is mounted in the second positioning recess 26 of the main body 20 and is directed toward a direction perpendicular to the axial direction of the main body 20. Thus, the second grinding unit 40 is directed toward a direction perpendicular to that of the first grinding unit 30.

The protective jacket 70 is mounted on the main body 20 and located between the extension neck 23 and the grip portion 21 of the main body 20. The protective jacket 70, the first grinding unit 30 and the second grinding unit 40 are located at the same side of the main body 20. The protective jacket 70 is located at a front portion of the grip portion 21 of the main body 20. The protective jacket 70 has a substantially L-shaped cross-sectional profile and has a first section 72 mounted on a bottom of a mediate portion of the main body 20 and facing the first grinding unit 30 and a second section formed with a protective plate 71 facing the grip portion 21 of the main body 20. The protective plate 71 of the protective jacket 70 is extended in a direction the same as that of the grip portion 21 of the main body 20 to separate the first grinding unit 30 from the grip portion 21 of the main body 20.

The cover 50 is removably mounted on an opening of the receiving chamber 22 of the grip portion 21 of the main body 20 to cover and seal the receiving chamber 22 and has an end pivotally mounted on a rear portion of the grip portion 21 of the main body 20.

The oil impregnated rubber 60 is detachably mounted in the receiving chamber 22 of the grip portion 21 of the main body 20 and is removable from the receiving chamber 22 of the grip portion 21 of the main body 20 when the cover 50 is opened.

Figure 5:
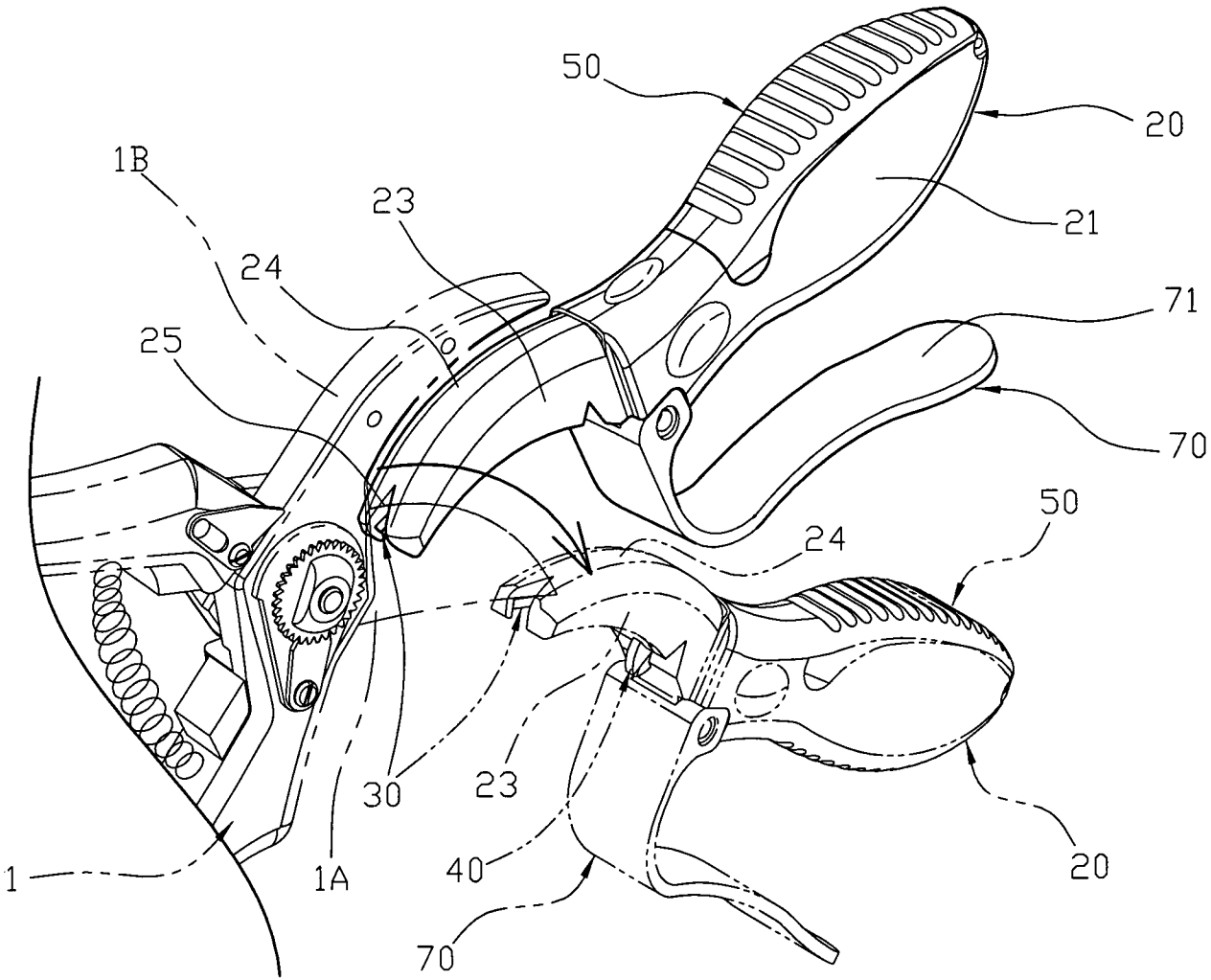
FIG. 5 is a schematic operational view of the blade sharpening tool as shown in FIG. 1 in use.

In operation, referring to FIG. 5 with reference to FIGS. 1–4, when the blade sharpening tool is available for a pair of gardening shears 1, the extension neck 23 of the main body 20 is rested on the jaw 1B of the gardening shears 1, and the first grinding unit 30 is rested on the blade 1A of the gardening shears 1 and located adjacent a connection of the blade 1A and the jaw 1B as shown in FIG. 5. At this time, the mating surface 24 of the extension neck 23 of the main body 20 has a shape corresponding to that of the jaw 1B of the gardening shears 1 to facilitate movement of the first grinding unit 30 on the blade 1A of the gardening shears 1. Then, the first grinding unit 30 is pressed to move on the blade 1A of the gardening shears 1 in the direction as indicated by the arrow shown in FIG. 5 so as to grind and sharpen the blade 1A of the gardening shears 1.

When the first grinding unit 30 is aligned with the blade 1A of the gardening shears 1, the blade 1A of the gardening shears 1 is directed toward the grip portion 21 of the main body 20. At this time, the protective jacket 70 is located between the extension neck 23 and the grip portion 21 of the main body 20 to separate the blade 1A of the gardening shears 1 from the grip portion 21 of the main body 20 to protect the user's one hand.

Figure 6:
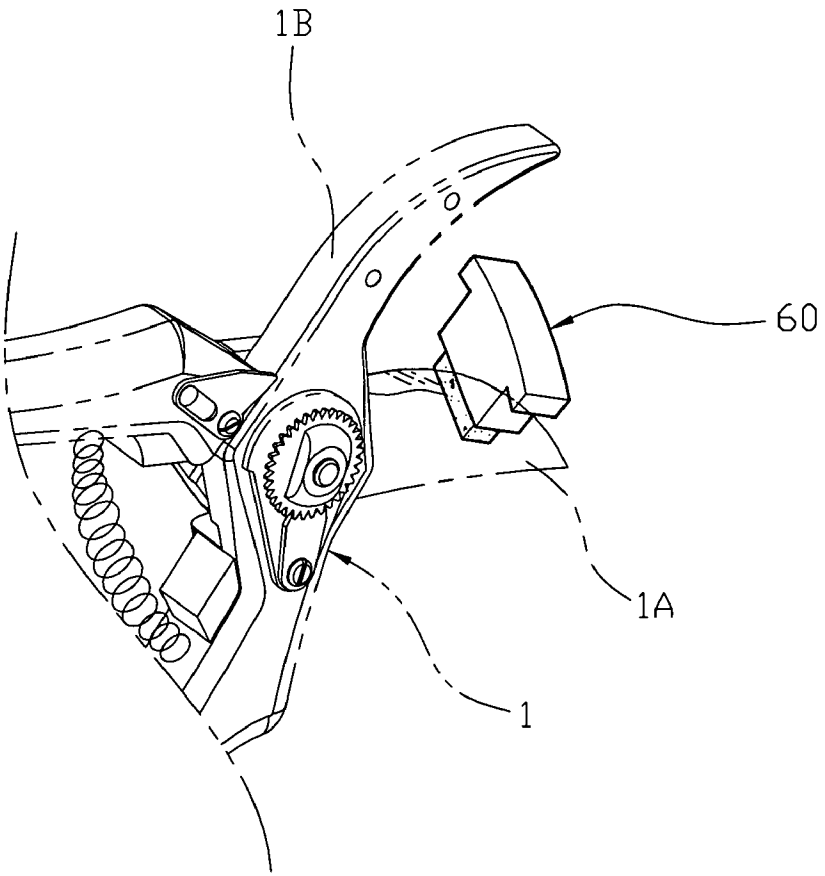
FIG. 6 is a schematic operational view of the blade sharpening tool as shown in FIG. 1 in use.

As shown in FIG. 6, the oil impregnated rubber 60 is used to lubricate the blade 1A of the gardening shears 1 after the blade 1A of the gardening shears 1 is sharpened.

Figure 7:
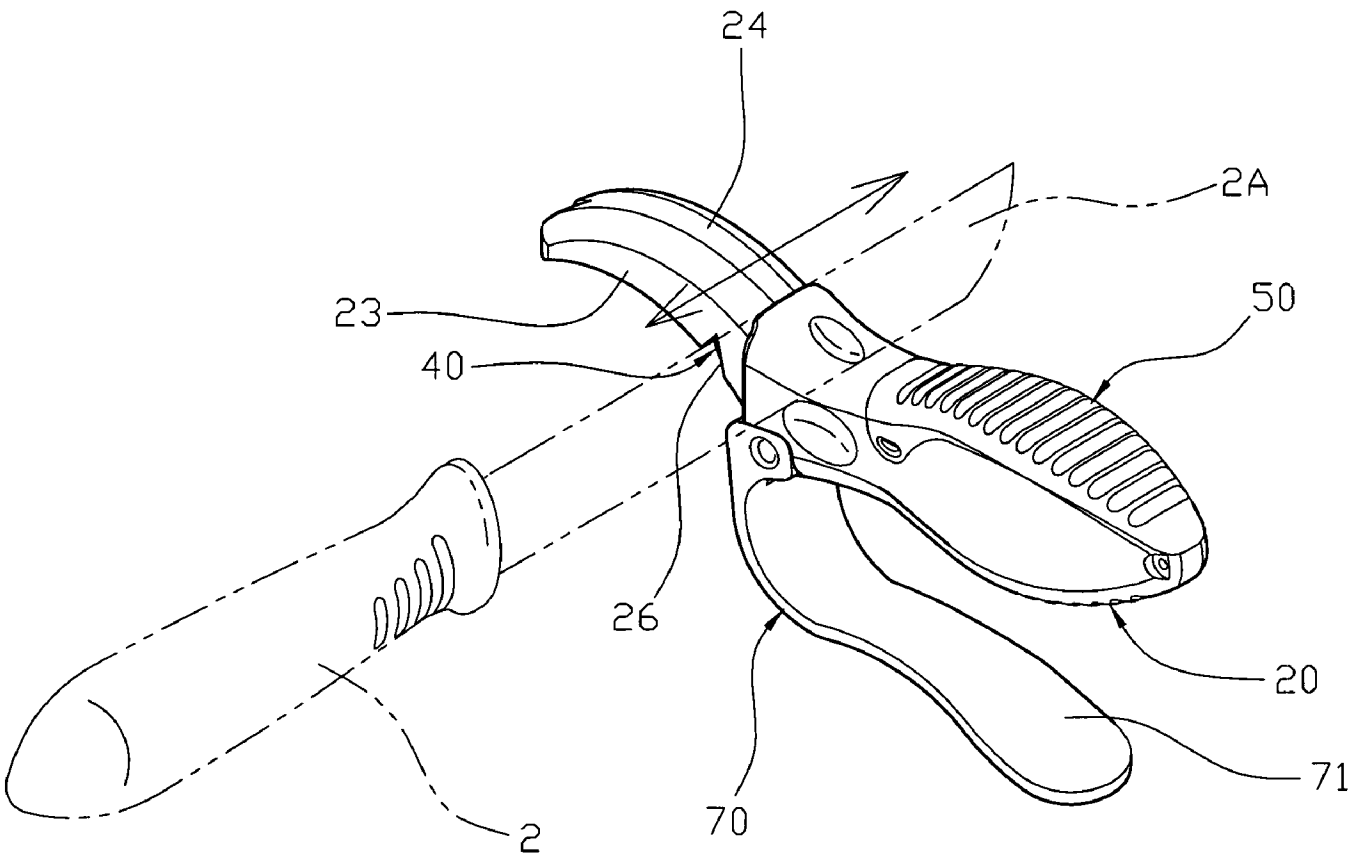
FIG. 7 is a schematic operational view of the blade sharpening tool as shown in FIG. 1 in use.
Figure 8:
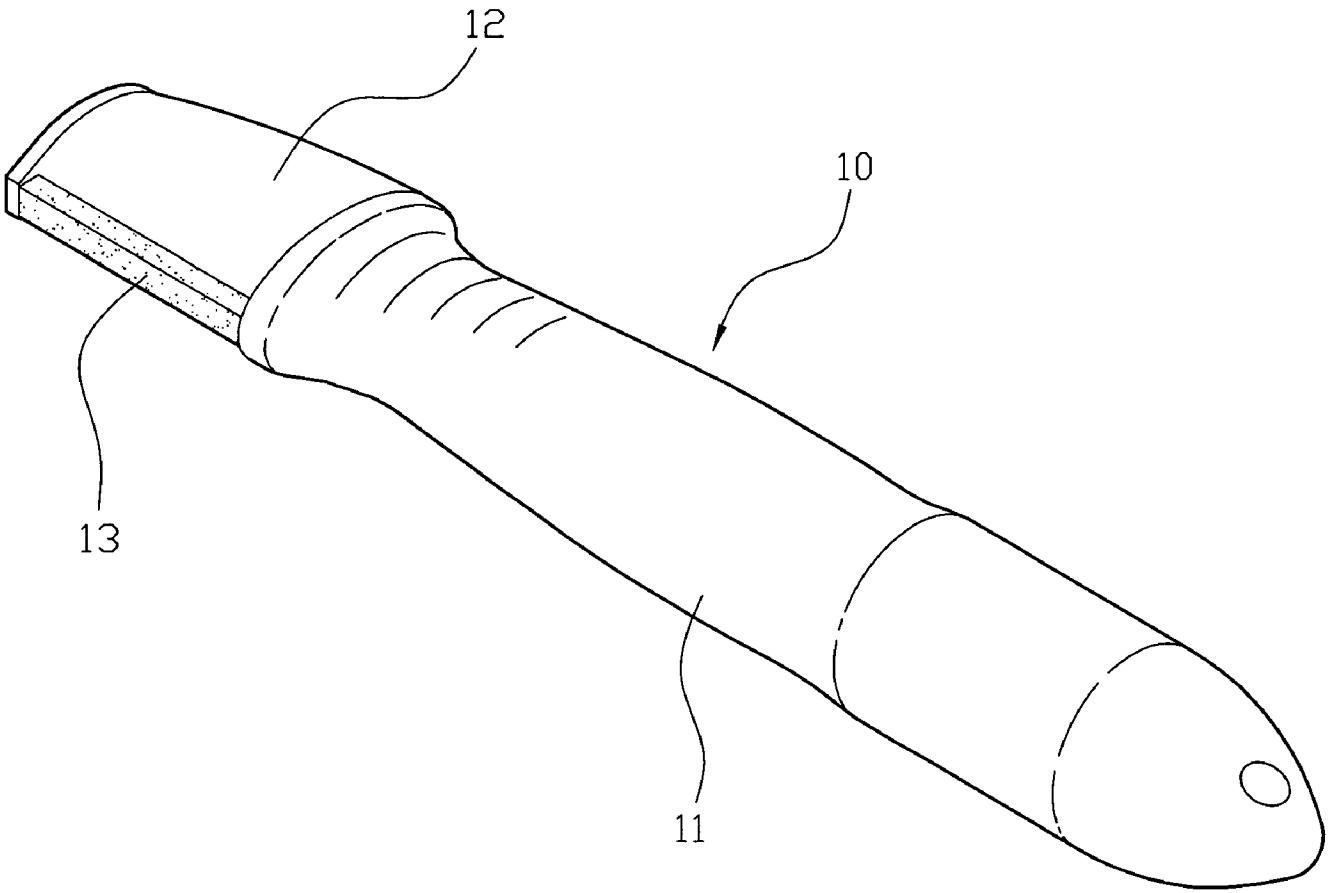
FIG. 8 is a perspective view of a conventional blade sharpening tool in accordance with the prior art.
Figure 9:
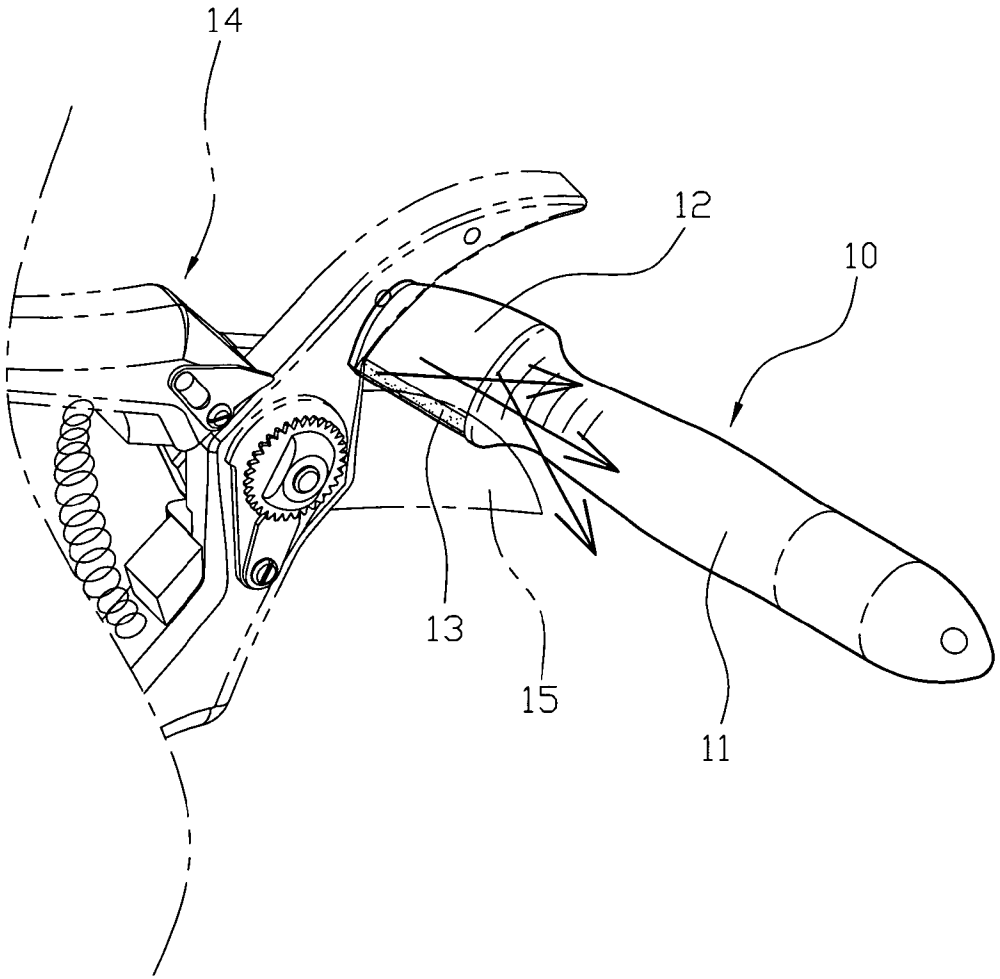
FIG. 9 PRIOR ART
FIG. 9 is a schematic operational view of the conventional blade sharpening tool as shown in FIG. 8 in use.

Alternatively, referring to FIG. 7 with reference to FIGS. 1–4, when the blade sharpening tool is available for a knife 2, the second grinding unit 40 is directly rested on the blade 2A of the knife 2 as shown in FIG. 7. Then, the second grinding unit 40 is pressed to move on the blade 2A of the knife 2 in the direction as indicated by the arrow shown in FIG. 7 so as to grind and sharpen the blade 2A of the knife 2.

Accordingly, when the first grinding unit 30 is pressed to move on the blade 1A of the gardening shears 1, the first grinding unit 30 is movable in the direction the same as that of the blade 1A of the gardening shears 1, so that the first grinding unit 30 is operated easily and quickly to facilitate the user operating the blade sharpening tool in an energy-saving manner. In addition, the mating surface 24 of the extension neck 23 of the main body 20 has a shape corresponding to that of the jaw 1B of the gardening shears 1 to facilitate movement of the first grinding unit 30 on the blade 1A of the gardening shears 1. Further, the protective jacket 70 is located between the extension neck 23 and the grip portion 21 of the main body 20 to separate the blade 1A of the gardening shears 1 from the grip portion 21 of the main body 20 to protect the user's one hand. Further, the second grinding unit 40 is directed toward a direction perpendicular to that of the first grinding unit 30, so that the blade sharpening tool is operated in two perpendicular manner, thereby enhancing the versatility of the blade sharpening tool.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A blade sharpening tool, comprising:

a main body having a front portion integrally formed with an extension neck and a rear portion formed with a grip portion which has an inside formed with a receiving chamber, the extension neck of the main body having a front end formed with a first positioning recess and a mediate portion having a bottom formed with a second positioning recess;

a first grinding unit mounted in the first positioning recess of the main body;

a second grinding unit mounted in the second positioning recess of the main body;

a protective jacket mounted on the main body and located between the extension neck and the grip portion of the main body;

a cover removably mounted on an opening of the receiving chamber of the grip portion of the main body to cover and seal the receiving chamber;

an oil impregnated rubber detachably mounted in the receiving chamber of the grip portion of the main body.

2. The blade sharpening tool in accordance with claim 1, wherein the extension neck of the main body has an upper portion formed with a substantially arc-shaped mating surface.

3. The blade sharpening tool in accordance with claim 1, wherein the extension neck of the main body has a rear end connected to the grip portion.

4. The blade sharpening tool in accordance with claim 1, wherein the first positioning recess of the main body is opened in a direction in line with an axial direction of the main body.

5. The blade sharpening tool in accordance with claim 1, wherein the second positioning recess of the main body is opened in a direction perpendicular to that of the first positioning recess.

6. The blade sharpening tool in accordance with claim 1, wherein the first grinding unit, the extension neck of the main body and the grip portion of the main body are arranged in a same line.

7. The blade sharpening tool in accordance with claim 1, wherein the first grinding unit is directed toward a direction in line with an axial direction of the main body.

8. The blade sharpening tool in accordance with claim 1, wherein the second grinding unit is directed toward a direction perpendicular to an axial direction of the main body.

9. The blade sharpening tool in accordance with claim 1, wherein the second grinding unit is directed toward a direction perpendicular to that of the first grinding unit.

10. The blade sharpening tool in accordance with claim 1, wherein the protective jacket, the first grinding unit and the second grinding unit are located at the same side of the main body.

11. The blade sharpening tool in accordance with claim 1, wherein the protective jacket is located at a front portion of the grip portion of the main body.

12. The blade sharpening tool in accordance with claim 1, wherein the protective jacket has a substantially L-shaped cross-sectional profile.

13. The blade sharpening tool in accordance with claim 1, wherein the protective jacket has a first section mounted on a bottom of a mediate portion of the main body and facing the first grinding unit and a second section formed with a protective plate facing the grip portion of the main body.

14. The blade sharpening tool in accordance with claim 13, wherein the protective plate of the protective jacket is extended in a direction the same as that of the grip portion of the main body to separate the first grinding unit from the grip portion of the main body.

15. The blade sharpening tool in accordance with claim 1, wherein the cover has an end pivotally mounted on a rear portion of the grip portion of the main body.

16. The blade sharpening tool in accordance with claim 1, wherein the oil impregnated rubber is removable from the receiving chamber of the grip portion of the main body when the cover is opened.

17. The blade sharpening tool in accordance with claim 1, wherein the first positioning recess of the main body is extended through an end face of the front end of the extension neck and has a substantially V-shaped cross-sectional profile.

* * * * *